United States Patent [19]

Stiffler et al.

[11] Patent Number: 4,911,504

[45] Date of Patent: Mar. 27, 1990

[54] CUTTER BIT AND TIP

[75] Inventors: Stephen P. Stiffler, New Enterprise; Wayne H. Beach, Roaring Spring; John J. Prizzi, Hempfield Township, Westmoreland County, all of Pa.

[73] Assignee: Kennametal Inc., Latrobe, Pa.

[21] Appl. No.: 221,820

[22] Filed: Jul. 20, 1988

[51] Int. Cl.[4] ..... E21C 35/10

[52] U.S. Cl. ..... 299/91; 172/713; 172/745; 175/410; 175/411; 407/118

[58] Field of Search ..... 299/86, 91, 79; 175/409–411, 374, 375; 76/101 E, 108 R, 108 A, DIG. 5, DIG. 11; 407/118; 172/745, 713; 51/309

[56] References Cited

U.S. PATENT DOCUMENTS

| | | | |
|---|---|---|---|
| 177,973 | 5/1876 | Trissler . | |
| 2,614,813 | 10/1952 | Shepherd . | |
| 2,628,072 | 2/1953 | Baker | 175/411 |
| 2,707,619 | 5/1955 | Anderson | 175/411 |
| 2,784,943 | 3/1957 | Bylund | 175/411 |
| 3,336,081 | 8/1967 | Ericsson | 299/91 |
| 3,557,416 | 1/1971 | Jones | 29/95 |
| 3,655,244 | 4/1972 | Swisher | 299/91 |
| 3,718,370 | 2/1973 | Caserta | 299/91 |
| 4,150,728 | 4/1979 | Garner et al. | 175/410 X |
| 4,176,725 | 12/1979 | Shields | 175/410 X |
| 4,190,127 | 2/1980 | Wolf | 175/410 |

FOREIGN PATENT DOCUMENTS

| | | | |
|---|---|---|---|
| 1089611 | 11/1967 | U.S.S.R. . | |
| 605955 | 5/1978 | U.S.S.R. . | |
| 751991 | 7/1980 | U.S.S.R. . | |
| 781341 | 11/1980 | U.S.S.R. | 299/91 |
| 372252 | 5/1932 | United Kingdom | 76/DIG. 11 |

OTHER PUBLICATIONS

Designing with Kennametal (1957).
Designing with Kennametal (1980).

*Primary Examiner*—Bruce M. Kisluik
*Attorney, Agent, or Firm*—John J. Prizzi

[57] ABSTRACT

A cemented carbide tip is provided with a socket for mounting onto the steel shank of a cutter bit. The socket has an annular convex surface therein extending from the earth engaging portion of the tip radially inwardly and forwardly. This convex surface is brazed to the forward end of a steel shank to form a cutter bit.

19 Claims, 2 Drawing Sheets

CUTTER BIT AND TIP

BACKGROUND OF THE INVENTION

The present invention relates to a wear resistant tip design and cutter bits utilizing this tip. It especially relates to cutter bits having a cemented carbide tip for use in construction and excavation applications.

In the past, a variety of cutter bit designs has been used in construction and excavation applications. These cutter bits have typically been tipped with a cemented tungstencarbide-cobalt insert which was brazed to the steel shank or body of the cutter bit.

Both rotatable and nonrotatable bits have been used in these applications. One of the early rotatable cutter bit designs involved a cemented carbide tip having an annular rear surface with a socket therein to which the forward end of the steel shank was brazed. The forward end of the steel shank had an annular forward surface with a forward projection thereon which partially extended into the socket (i.e., the depth of the socket was greater than the height of the forward projection). The braze joint between the steel and the cemented carbide was thus thickest at the forward end of the steel projection and thinnest at the facing annular surfaces of the cemented carbide and steel. While rotatable cutter bits of the foregoing design were commercially used, the cemented carbide of the tip was susceptible to fracture during usage.

The foregoing design was superseded by rotatable cutter bit designs in which the rear of the carbide was flat, or had a so-called valve seat design, either of which was brazed into a socket in the forward end of the steel (see, for example, U.S. Pat. Nos. 4,497,520 and 4,216,832, and West German Offenlegungschrift No. 2846744).

Examples of cutter bit designs utilizing a socket in the rear of the carbide are shown in South African Patent No. 82/9343; Russian Inventor's Certificate No. 402655; Published Swedish Patent Application No. 8400269-0 and U.S. Pat. No. 4,547,020.

SUMMARY OF THE INVENTION

In accordance with the present invention, an improved cemented carbide tip is provided for use as the forward end of an cutter bit. The tip is rotationally symmetric about its longitudinal axis and has an earth engaging outer portion and a mounting portion. The mounting portion has an annular rearwardly facing convex surface and a second surface located radially inside of and forward of the annular surface, thereby forming a socket in the rear of the tip. The convex surface extends to the earth engaging portion of the tip while also preferably extending to the aforementioned second surface. The tip, preferably, further includes a means for substantially centering the tip about a steel protrusion which is to be brazed into the socket. The means for centering preferably takes the form of bump extending radially inwardly from the convex annular surface of the tip.

Also in accordance with the present invention, a cutter bit is provided having a cemented carbide tip joined to one end of a ferrous metal body. The cemented carbide tip has an outer earth engaging portion and a mounting portion. The mounting portion includes an annular rearwardly facing surface facing the forward end of the ferrous body and tapering radially inwardly while extending forwardly from a junction with the earth engaging outer portion of the tip. The mounting portion further includes a second rearwardly facing surface located radially within the aforementioned annular surface. A braze joint joins the second rearwardly facing surface and the annular rearwardly facing surface to the forward end of the ferrous body. The average thickness of the braze joint adjacent the second rearwardly facing surface is smaller than the average thickness of the braze joint adjacent the annular rearwardly facing surface.

These and other aspects of the present invention will become more apparent upon review of the drawings, which are briefly described below in conjunction with the detailed description of the invention.

DETAILED DESCRIPTION OF THE INVENTION

Figure 1:
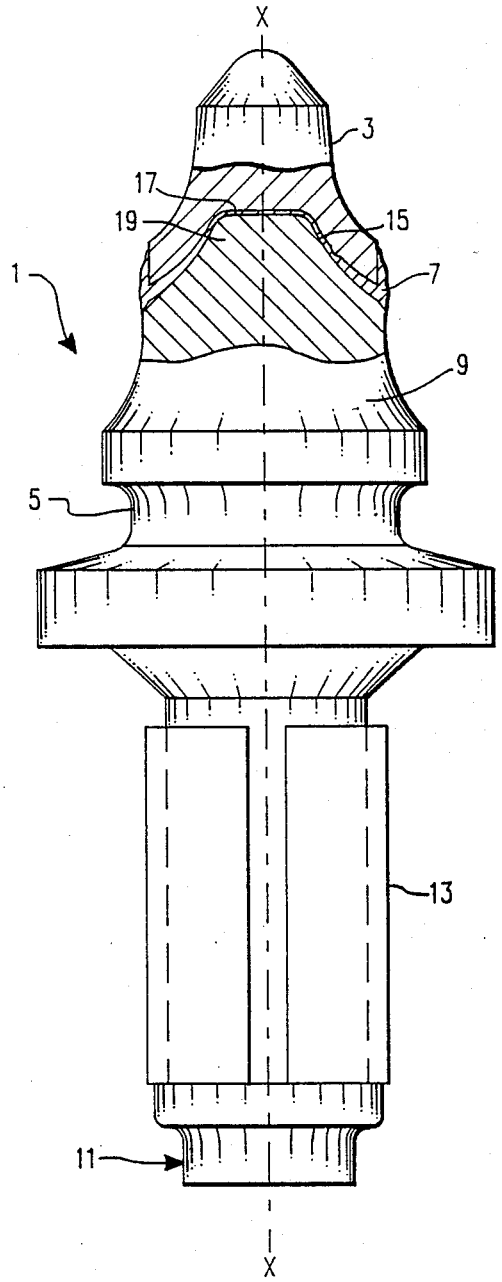
FIG. 1 shows a plan view in partial cross section of a cutter bit in accordance with the present invention having a preferred embodiment of a cemented carbide tip also in accordance with the present invention brazed thereon.

Shown in FIG. 1 is a preferred embodiment of rotatable cutter bit 1 having a cemented tungsten carbide-cobalt tip 3 joined to a ferrous metal body 5, here steel, by a braze joint 7. The steel body 5 extends along and is preferably rotationally symmetric about a longitudinal axis X—X which extends between the forward end 9 and rearward end 11 of the body 5. The rearward end 11 of the steel body 5 may have loosely retained thereon a resilient retainer member 13 for releasably holding the cutter bit rotatable in the bore of a mounting block on a conventional construction or excavating machine (not shown). This and other styles of resilient retainer means useful in the present invention are described in U.S. Pat. Nos. 3,519,309 and 4,201,421.

The forward end 9 of the ferrous body 5 has a first annular forwardly facing surface 15 which tapers radially inwardly as it extends forwardly and preferably is convex in cross section and rotationally symmetric about the longitudinal axis. At or near the forward end of the surface 15 is a second forwardly facing surface 17 which preferably lies in a plane perpendicular to the longitudinal axis. These forwardly facing surfaces 15 and 17 form protrusion 19 which is substantially receivable in a socket in the tip 3. All sharp inside and outside corners preferably are removed and replaced by fillets or chamfers.

The height, H, of the protrusion is preferably greater than the depth, D, of a generally complementary shaped socket 21 in the cemented tungsten carbide-cobalt tip 3 so that when the protrusion 19 is brazed to the socket 21 the thickness of the resultant braze joint will be smaller adjacent the second forwardly facing surface 17 than it is adjacent the annular forwardly facing surface 15.

Figure 2:
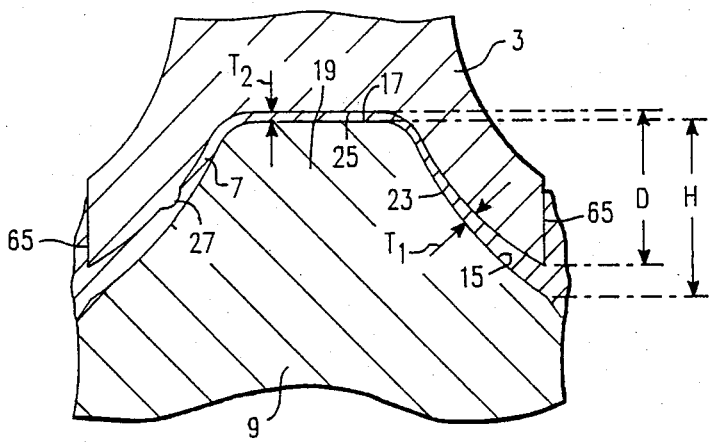
FIG. 2 shows an enlarged view of the braze joint shown in cross section in FIG. 1.

In FIG. 2, the foregoing is shown more clearly. The cemented carbide tip 3 has an annular convex surface 23 facing the forward end 9 of the steel body, and more particularly, facing the annular forwardly facing concave surface 15 on the steel body. Located radially inside of, and forward of, annular rearward facing surface 23 is a second rearwardly facing surface 25. The depth, D, of the socket 21 defined by surfaces 23 and 25 is preferably less than the height, H. The socket and protrusion have been sized such that, in the absence of braze metal, the tip can be seated on the surface 17 of the steel body without touching surface 15 of the steel body.

This results in a braze joint 7 which has an average thickness, $T_1$, between the annular rearwardly facing surface 23 of the tip and the annular forwardly facing surface 15 of the steel body which is greater than the average thickness, $T_2$, between rearwardly facing surface 25 of the tip and forwardly facing surface 17 of the ferrous body. Thickness, $T_1$, is preferably between about 0.008 to 0.024 inch, and more preferably, between about 0.010 to 0.016 inch thick. Thickness, $T_2$, is preferably between about 0.001 to 0.006 inch, and more preferably, between about 0.002 to 0.004 inch thick. Preferably, $T_1$ is at least twice $T_2$ and, more preferably, at least three times $T_2$. In order to substantially maintain the uniformity of the braze joint thickness, $T_1$, around the circumference of the protrusion surface 15, it is preferred that a centering means be located between the inwardly tapering surface 23 of the tip socket and the tapering surface 15 on the protrusion. This centering means is preferably a part of the tip and preferably takes the form of bumps 27 extending radially inwardly from the inwardly tapering surface 23 of the tip socket and are circumferentially distributed on this surface. Preferably, there are three bumps 27 located at 120 degrees to each other.

The size of the bumps 31 should be such that, while they assist in assuring substantial uniformity of the braze thickness, $T_1$, they are not so large so as to interfere with the maintenance of the requirement that $T_2$ is less than $T_1$. Spherical shape bumps having a height of about 0.005 to 0.008 inches above surface 23 are suitable for this purpose. By assuring that the foregoing relation exists between $T_2$ and $T_1$, it is believed that tip fracture in use will be minimized while providing a strong, long-lived joint between the tip and the steel body, thereby minimizing tip loss.

Figure 3:
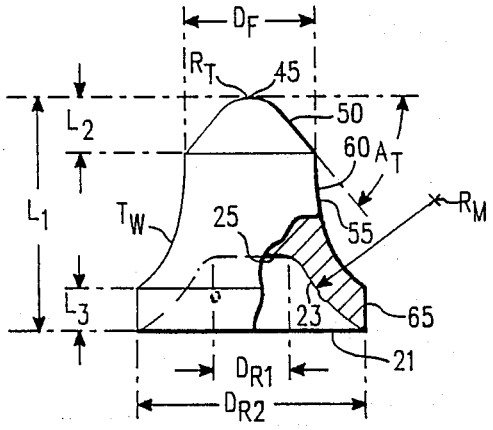
FIG. 3 shows a plan view of an embodiment of a tip in accordance with the present invention in partial cross section.
Figure 4:
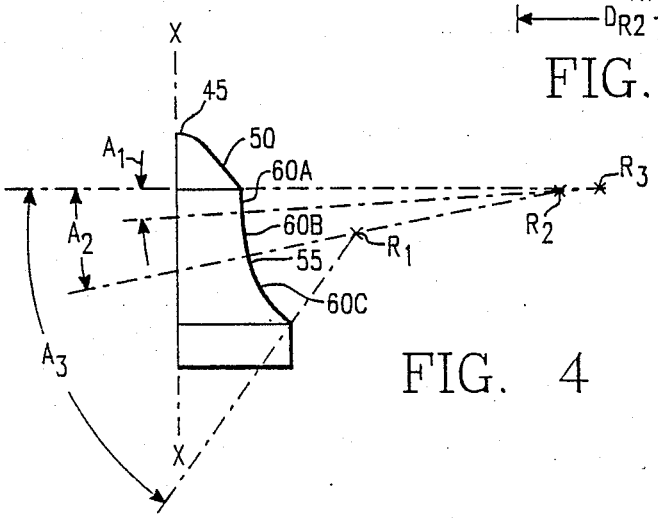
FIG. 4 shows half a plan view of the tip shown in FIG. 3.

In the preferred embodiment, the depth, D, may be calculated from a plane defined by the rearmost edge of surface 23 which occurs where it meets cylindrical surface 65. To be consistent, the height, H, of the steel protrusion in this situation would be calculated from a plane defined by where surface 15 intersects diameter $D_{R2}$, the outer diameter of tip surface 65 (see FIG. 3).

It is further preferred that a high temperature braze material be used in joining the tip to the ferrous body so that braze joint strength is maintained over a wide temperature range. Preferred braze materials are Handy Hi-temp® 548, Trimet® 549, 080 and 655. Most preferred are the 548 and 549 braze materials. Handy Hi-temp®-548 alloy is composed of 55±1.0 w/o (weight percent) Cu, 6±0.5 w/o Ni, 4±0.5 w/o Mn, 0.15±0.05 w/o Si, with the balance zinc and 0.50 w/o maximum total impurities. The Handy Hi-temp®-Trimet® 549 is a 1-2-1 ratio Trimet® clad strip of Handy Hi-temp®548 on both sides of copper. Further information on Handy Hi-temp® 548 and Trimet® 549 can be found in Handy & Harman Technical Data Sheet Number D-74. The foregoing braze alloys are manufactured and sold by Handy & Harman Inc., 859 Third Avenue, New York, N.Y. 10022. Handy Hi-temp and Trimet are registered trademarks of Handy & Harman Inc.

Acceptable braze joints may be achieved by using braze discs which have been shaped into cups, fitted between the socket of the tip and the protrusion of the ferrous body and then brazed by conventional induction brazing techniques which, in addition to brazing the tip to the steel body, also hardens the steel which may be any of the standard steels used for rotatable cutter bit bodies. After the brazing and hardening step, the steel is tempered to a hardness of Rockwell C 40–45. The cemented carbide tip may be composed of any of the standard tungsten carbide-cobalt compositions conventionally used for construction and excavation applications. For example, for rotatable asphalt reclamation cutter bits, a standard tungsten carbide grade containing about 5.7 w/o cobalt and having a Rockwell A hardness of about 88.2 may be desirable.

The earth engaging surfaces of the tip may have any of the conventional sizes or shapes previously used in the art. However, a preferred design is shown in FIGS. 1–4. In the design shown, the forward end of the earth engaging surfaces has a spherical nose 45 having a radius $R_T$, joined to a frustoconical surface 50 tapering away from the rotational axis of symmetry, X—X, as it extends rearwardly at an angle 90-$A_T$, to form a maximum diameter, $D_F$ at a distance $L_2$ from the forward end of nose 45. Joined to frustoconical surface 50 is a bell shaped section 55 having an earth engaging concave surface 60 at whose rear end is joined a uniform diameter protective surface 65. The concave surface is formed by a series of concave surfaces 60A, 60B and 60C, each having a different radius of curvature and wherein the radii decrease as one moves rearwardly along the length of the tip (i.e., 60A>60B>60C). While any number of radii, $R_N$, or arcs, $A_N$, may be used, it is preferred that at least three radii (or arcs) be used to form the smooth continuous surface 60, here shown as $R_1$, $R_2$ and $R_3$, and $A_1$, $A_2$ and $A_3$. The rear end of the concave surface 60 joins cylindrical surface 65 which preferably has a diameter $D_{R2}$ which is not only greater than $D_F$, but is of sufficient size to completely, or at least substantially cover the entire forward surface of the steel body to which the tip is brazed (i.e., more than 98% of the forward surface diameter). Maximum protection from wear t the forward end of the steel shank is thereby provided by the cemented carbide tip, thus reducing the rate of wear on the forward end 9 of steel body.

The use of the concave surface 60 of variable radius as shown allows a tip to be manufactured having increased length $L_1$ while assuring maximum strength and a substantially even distribution of stresses during use to thereby minimize tip fracture in use.

The internal diameter of the socket $D_{RI}$, and its shape, can be selected to provide a substantially uniform wall thickness, $T_W$, especially in the zone of the concave section 60. For example, convex surface 23 may be concentric with earth engaging surface 60C to provide a uniform wall thickness while maximizing the length, $L_3$, of cylindrical surface 65. Alternatively, surfaces 23 and 60C may diverge as they extend forwardly to maximize wall thickness near the forward end of socket 21. The flat circular surface 25 at the forward end of the socket provides a large area for brazing to the forward end surface of the protrusion on the steel body. This structure, in combination with the thin braze joint thickness at this location, provides assurance that, during use, most significant loads applied to the tip will place the tip in compression rather than tension. Examples of dimensions which applicants believe to be acceptable are shown in Table I. These dimensions should be used with the previously provided dimensions.

TABLE I

EXEMPLARY TIP DIMENSIONS

| Attribute | Radius (inch) | Diameter (inch) | Angle (degree) | Length or Thickness (inch) |
|---|---|---|---|---|
| $R_1$ | 1.179 | | | |
| $R_2$ | 1.047 | | | |
| $R_3$ | 0.363 | | | |
| $R_M$ | 0.485 | | | |
| $A_1$ | | | 3.708 | |
| $A_2$ | | | 11.630 | |
| $A_3$ | | | 53.672 | |
| $R_T$ | 0.125 | | | |
| $A_T$ | | | 50 | |
| $L_1$ | | | | 0.765 |
| $L_2$ | | | | 0.184 |
| $L_3$ | | | | 0.248 |
| $T_W$ | | | | 0.122 |
| $D_F$ | | 0.425 | | |
| $D_{R1}$ | | 0.285 | | |
| $D_{R2}$ | | 0.750 | | |

All patents and documents referred to herein are hereby incorporated by reference.

As is well known to those of ordinary skill in the art, that the junctures of the various surfaces described on the carbide tip, chamfers, fillets and/or pressing flats may be provided, where appropriate, to assist in manufacturing and/or provide added strength to the structure.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. A cutter bit comprising:
a ferrous body having a longitudinal axis and a forward end;
a cemented carbide tip;
said cemented carbide tip having:
an earth engaging outer portion;
an annular rearwardly facing surface facing said forward end of said ferrous body and tapering radially inwardly while extending forwardly from a junction with the earth engaging outer portion;
and a rearwardly facing surface located radially within said annular rearwardly facing surface; and
a braze joint joining said rearwardly facing surface and said annular rearwardly facing surface to said forward end of said ferrous body;
and wherein said braze joint has an average thickness adjacent said rearwardly facing surface which is smaller than the average thickness of said braze joint adjacent said annular rearwardly facing surface.

2. A cutter bit comprising:
a ferrous metal body having a longitudinal axis and a forward end;
a cemented carbide tip;
said cemented carbide tip having
an earth engaging outer portion;
an annular rearwardly facing surface facing said forward end of said ferrous body and tapering radially inwardly while extending forwardly from a junction with the earth engaging outer portion;
and a rearwardly facing surface located radially inwardly of said annular rearwardly facing surface;
a braze joint joining said rearwardly facing surface and said annular rearwardly facing surface to said forward end of said ferrous body;
wherein said braze joint has an average thickness adjacent said rearwardly facing surface which is smaller than the average thickness of said braze joint adjacent said annular rearwardly facing surface;
and wherein said annular rearwardly facing surface is convex.

3. The cutter bit according to claim 2 wherein said earth engaging outer portion has a concave surface thereon facing radially outwardly in a direction substantially opposite to said annular rearwardly facing surface.

4. The cutter bit according to claim 2 wherein said earth engaging outer portion has a concave surface thereon and said concave surface is concentric with said annular rearwardly facing surface.

5. A cutter bit comprising:
a ferrous body having a longitudinal axis and a forward end;
a cemented carbide tip;
said cemented carbide tip having
an earth engaging outer portion;
said earth engaging outer portion terminating in a radially outwardly facing rearmost surface;
an annular rearwardly facing surface facing the forward end of said ferrous body and tapering radially inwardly while extending forwardly from a junction with said radially outwardly facing rearmost surface of the earth engaging outer portion;
said junction defining a plane perpendicular to said longitudinal axis;
a second rearwardly facing surface located radially inwardly of said annular rearwardly facing surface and forward of said plane by a distance, D;
and said second rearwardly facing surface and said annular rearwardly facing surface brazed to the forward end of said steel body.

6. The cutter bit according to claim 5 wherein said earth engaging outer portion has a concave surface thereon facing radially outwardly in a direction substantially opposite to said annular rearwardly facing surface.

7. A cemented carbide tip for a cutter bit, said tip comprising:
an earth engaging portion having a forward and a rearward end and being rotationally symmetric about a longitudinal axis;
a mounting portion for attachment to a cutter bit shank;
said earth engaging portion having a concave surface thereon facing radially outwardly;
said mounting portion having a convex surface thereon facing radially inwardly, and extending to said earth engaging portion.

8. The cemented carbide tip according to claim 7 wherein said concave surface is concentric with said convex surface.

9. The cemented carbide tip according to claim 7 wherein said earth engaging portion includes a radially outward facing cylindrical surface thereon connecting said concave surface and said convex surface.

10. The cemented carbide tip according to claim 9 wherein said concave surface is concentric with said convex surface.

11. The cemented carbide tip according to claim 7 wherein said mounting portion further includes a rearwardly facing surface located radially inside of and adjacent to said convex surface.

12. The cemented carbide tip according to claim 17 wherein said rearwardly facing surface is planar and located forwardly of said convex surface.

13. The cemented carbide tip according to claim 7 wherein said convex surface has bumps thereon.

14. The cemented carbide tip according to claim 13 wherein said bumps include a first bump, and a second bump, and a third bump, and said bumps are circumferentially spaced at 120 degrees to each other about said longitudinal axis.

15. The cemented carbide tip according to claim 7 wherein said convex surface has a first radius of curvature and said concave surface has a second radius of curvature and said first radius of curvature is greater than said second radius of curvature.

16. A cutter bit comprising:

a ferrous body having a longitudinal axis and a forward end;

a cemented carbide tip;

said cemented carbide tip having an earth engaging portion;

an annular rearwardly facing surface facing the forward end of said ferrous body and tapering radially inwardly while extending forwardly from a junction with the earth engaging portion;

said junction defining a plane perpendicular to said longitudinal axis;

a second rearwardly facing surface located radially inwardly of said annular rearwardly facing surface and forward of said plane by a distance, D;

and wherein said annular rearwardly facing surface is convex.

17. A cutter bit comprising:

a ferrous body having a longitudinal axis and a forward end;

a cemented carbide tip;

said cemented carbide tip having an earth engaging portion;

an annular rearwardly facing surface facing the forward end of said ferrous body and tapering radially inwardly while extending forwardly from a junction with the earth engaging portion;

said junction defining a plane perpendicular to said longitudinal axis;

a second rearwardly facing surface located radially inwardly of said annular rearwardly facing surface and forward of said plane by a distance, D;

said second rearwardly facing surface and said annular rearwardly facing surface brazed to the forward end of said steel body;

and wherein said earth engaging portion has a concave surface thereon facing radially outwardly in a direction substantially opposite to said annular rearwardly facing surface.

18. A cutter bit comprising:

a ferrous body having a longitudinal axis and a forward end;

a cemented carbide tip;

said cemented carbide tip having an earth engaging portion;

an annular rearwardly facing surface facing the forward end of said ferrous body and tapering radially inwardly while extending forwardly from a junction with the earth engaging portion;

said junction defining a plane perpendicular to said longitudinal axis;

a second rearwardly facing surface located radially inwardly of said annular rearwardly facing surface and forward of said plane by a distance, D;

wherein said annular rearwardly facing surface is convex;

and wherein said earth engaging portion has a concave surface thereon facing radially outwardly in a direction substantially opposite to said annular rearwardly facing surface.

19. A cutter bit comprising:

a ferrous body having a longitudinal axis and a forward end;

a cemented carbide tip;

said cemented carbide tip having and earth engaging portion;

an annular rearwardly facing surface facing the forward end of said ferrous body and tapering radially inwardly while extending forwardly from a junction with the earth engaging portion;

said junction defining a plane perpendicular to said longitudinal axis;

a second rearwardly facing surface located radially inwardly of said annular rearwardly facing surface and forward of said plane by a distance, D;

wherein said annular rearwardly facing surface is convex;

and wherein said earth engaging portion has a concave surface thereon and said concave surface is concentric with said annular rearwardly facing surface.

* * * * *